US011133622B2

(12) United States Patent
Misu et al.

(10) Patent No.: US 11,133,622 B2
(45) Date of Patent: Sep. 28, 2021

(54) CONNECTOR WITH CONNECTION DETECTION MEMBER

(71) Applicant: Sumitomo Wiring Systems, Ltd., Mie (JP)

(72) Inventors: Takeshi Misu, Mie (JP); Masato Kamemura, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/956,713

(22) PCT Filed: Dec. 17, 2018

(86) PCT No.: PCT/JP2018/046289
§ 371 (c)(1),
(2) Date: Jun. 22, 2020

(87) PCT Pub. No.: WO2019/131264
PCT Pub. Date: Jul. 4, 2019

(65) Prior Publication Data

US 2020/0335911 A1 Oct. 22, 2020

(30) Foreign Application Priority Data

Dec. 26, 2017 (JP) ..... JP2017-249633

(51) Int. Cl.
*H01R 13/639* (2006.01)
*H01R 13/641* (2006.01)
*H01R 13/627* (2006.01)

(52) U.S. Cl.
CPC ..... *H01R 13/639* (2013.01); *H01R 13/641* (2013.01); *H01R 13/6275* (2013.01)

(58) Field of Classification Search
CPC . H01R 13/639; H01R 13/641; H01R 13/6275
See application file for complete search history.

(56) References Cited

U.S. PATENT DOCUMENTS 5,203,718 A * 4/1993 Chishima ..... H01R 13/641 439/350
6,435,895 B1 * 8/2002 Fink ..... H01R 13/6272 439/352

(Continued)

FOREIGN PATENT DOCUMENTS

JP 2009-277564 11/2009
JP 2012-511805 5/2012

OTHER PUBLICATIONS

International Search Report dated Feb. 26, 2019.

*Primary Examiner* — Tho D Ta
(74) *Attorney, Agent, or Firm* — Gerald E. Hespos; Michael J. Porco; Matthew T. Hespos

(57) ABSTRACT

A connector (10) includes a housing (20) and a separate connection detecting member (60). The connection detecting member (60) has a flexible and cantilevered locking lance (66). The housing (20) has a locking portion (38) with an opening and capable of locking the connection detecting member (60) by a projection (70) of the locking lance (66) coming into contact with an inner wall of the locking portion (38). The connection detecting member (60) is relatively displaceable between a connection assurance position and a connection assurance release position. When the connection detecting member (60) is displaced from the connection assurance release position to the connection assurance position, the projection (70) of the locking lance (66) slides against the inner wall of the locking portion (38) and the locking lance (66) is displaced resiliently to release the locking of the connection detecting member (60).

2 Claims, 28 Drawing Sheets

(56) References Cited

U.S. PATENT DOCUMENTS

| | | | | |
|---|---|---|---|---|
| 6,908,329 | B2 * | 6/2005 | Kozono | H01R 13/641 439/352 |
| 7,530,838 | B2 * | 5/2009 | Ohara | H01R 13/641 439/489 |
| 7,909,638 | B2 * | 3/2011 | Seo | H01R 13/6272 439/489 |
| 7,980,887 | B2 * | 7/2011 | Urano | H01R 13/639 439/489 |
| 8,920,187 | B2 * | 12/2014 | Kon | H01R 13/6272 439/354 |
| 2010/0255709 | A1 | 10/2010 | Tyler | |
| 2012/0282791 | A1 | 11/2012 | Brown et al. | |

* cited by examiner

CONNECTOR WITH CONNECTION DETECTION MEMBER

BACKGROUND

Field of the Invention

This specification relates to a connector.

Related Art

Japanese Unexamined Patent Application Publication No. 2012-511805 discloses a connector assembly composed of a plug outer housing including a flexible latch, a floating latch slidably connected to the plug outer housing and a header outer housing to be connected to the plug outer housing.

The floating latch has a substantially rectangular shape and the inside thereof is cut into a substantially rectangular shape. A locking tab projects down on a rear part of the floating latch.

The flexible latch is cantilevered on the plug outer housing and is provided with a lock claw to be engaged with the locking tab of the floating latch.

The locking tab of the floating latch rides over the lock claw of the flexible latch when the plug outer housing and the header outer housing are connected. Thus, the lock claw and the locking tab are sliding against each other. However, there is a problem that the locking tab is scraped if the housings are connected repeatedly.

SUMMARY

This specification relates to a connector with a housing to be connected to a mating housing, and a separate connection detecting member to be mounted on the housing for connection assurance of the housing and the mating housing. A flexible locking lance is cantilevered on the connection detecting member, and the housing includes a locking portion with an opening and is capable of locking the connection detecting member. A tip of the locking lance of the connection detecting member contacts an inner wall of the locking portion of the housing to lock the connection detecting member together with the housing. The connection detecting member is displaceable between a connection assurance position and a connection assurance release position. Connection assurance is made at the connection assurance position and the connection detecting member is locked by the locking portion. Connection assurance is released at the connection assurance release position. Thus, locking of the connection detecting member with the locking portion is released, and the tip of the locking lance slides against the inner wall of the locking portion. The locking lance is displaced resiliently when the connection detecting member is displaced from the connection assurance release position to the connection assurance position so that the locking of the connection detecting member is released.

As described above, the locking lance is displaced resiliently if the tip of the locking lance contacts the inner wall of the locking portion. Thus, a stress applied to the tip of the locking lance can be alleviated and the tip of the locking lance will not be scraped, as compared to the case where the locking lance is not resiliently displaced.

Further, the connection detecting member may be mounted slidably on the housing and may be displaceable from the connection assurance release position to the connection assurance position by being slid. The locking lance may be parallel to a sliding direction of the connection detecting member. The tip of the locking lance may project into the locking portion from a sliding surface of the locking lance against the housing at the connection assurance release position, and the tip of the locking lance may contact the inner wall of the locking portion by sliding the connection detecting member during a displacement from the connection assurance release position to the connection assurance position. Accordingly, the locking lance is displaced resiliently in a direction opposite to a projecting direction of the tip, and the locking of the connection detecting member is released.

Further, the connection detecting member may be mounted slidably on the housing. Additionally, the locking lance may project into the locking portion and the tip of the locking lance may be located in the locking portion at the connection assurance release position. The connection detecting member may be displaceable from the connection assurance release position to the connection assurance position by being slid, and the tip of the locking lance may contact the inner wall of the locking portion by sliding the connection detecting member during a displacement from the connection assurance release position to the connection assurance position. Accordingly, the locking lance is displaced resiliently in a direction opposite to a sliding direction of the connection detecting member from the connection assurance release position to the connection assurance position and the locking of the connection detecting member is released.

According to the connector disclosed in this specification, it is possible to prevent the tip of the locking lance from being scraped by alleviating a stress applied to the tip of the locking lance of the connection detecting member being mounted on the connector.

DETAILED DESCRIPTION

First Embodiment

A first embodiment is described with reference to FIGS. 1 to 25.

Figure 1:
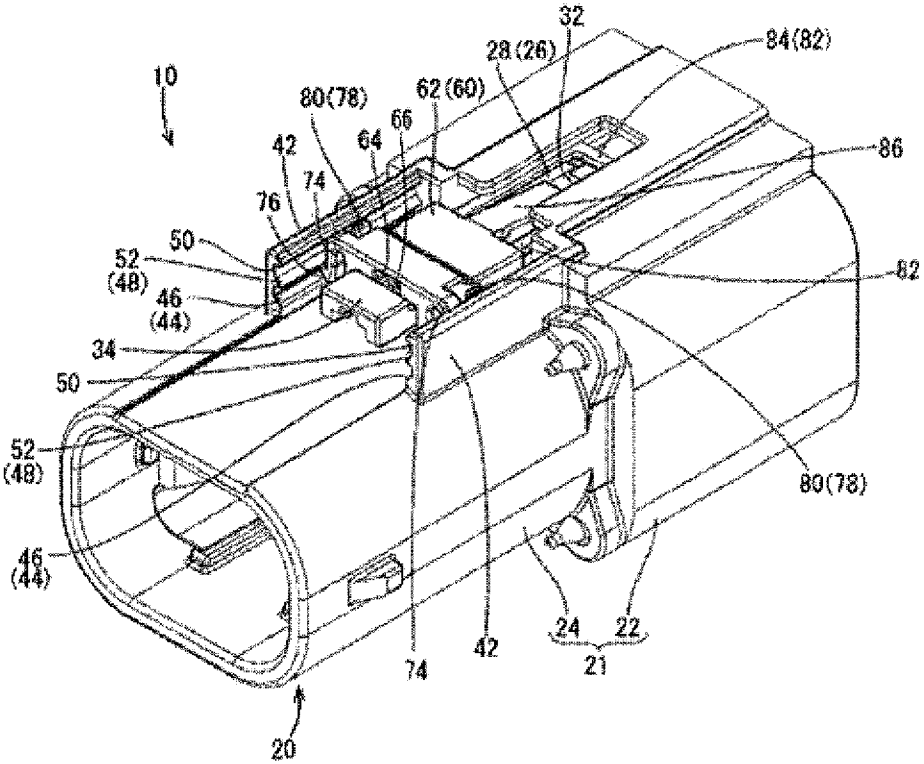
FIG. 1 is a rear perspective view of a connector in a first embodiment.
Figure 4:
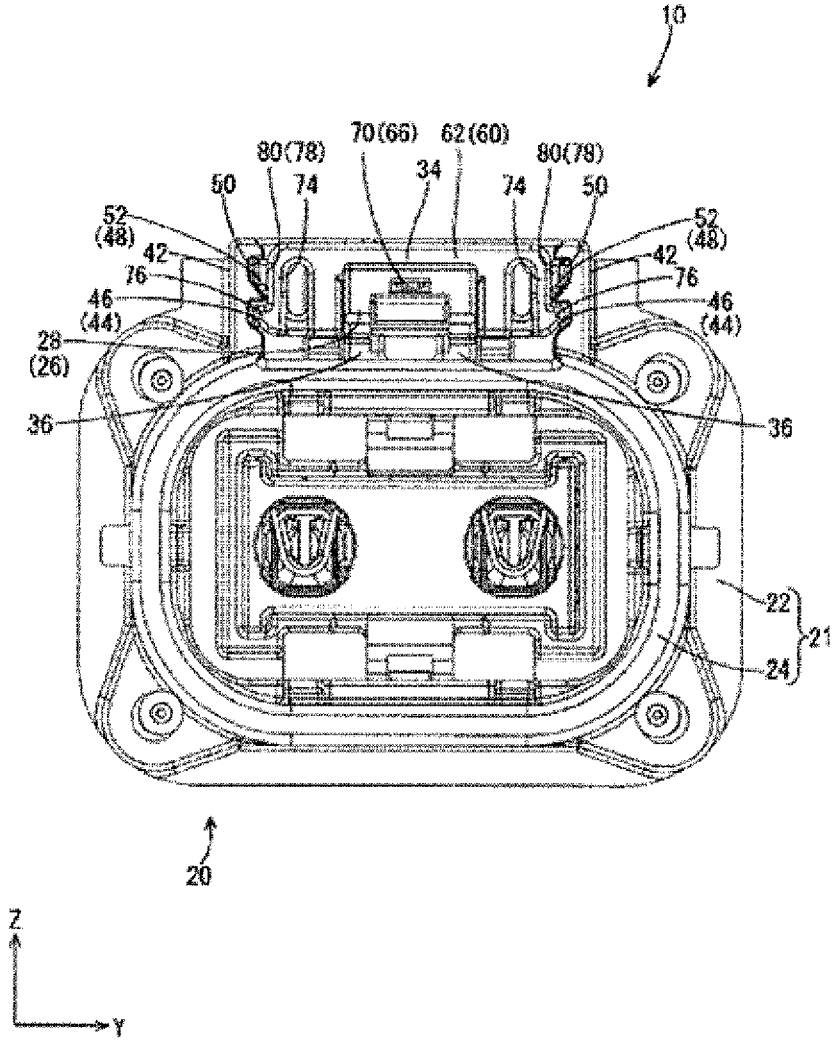
FIG. 4 is a back view of the connector.
Figure 5:
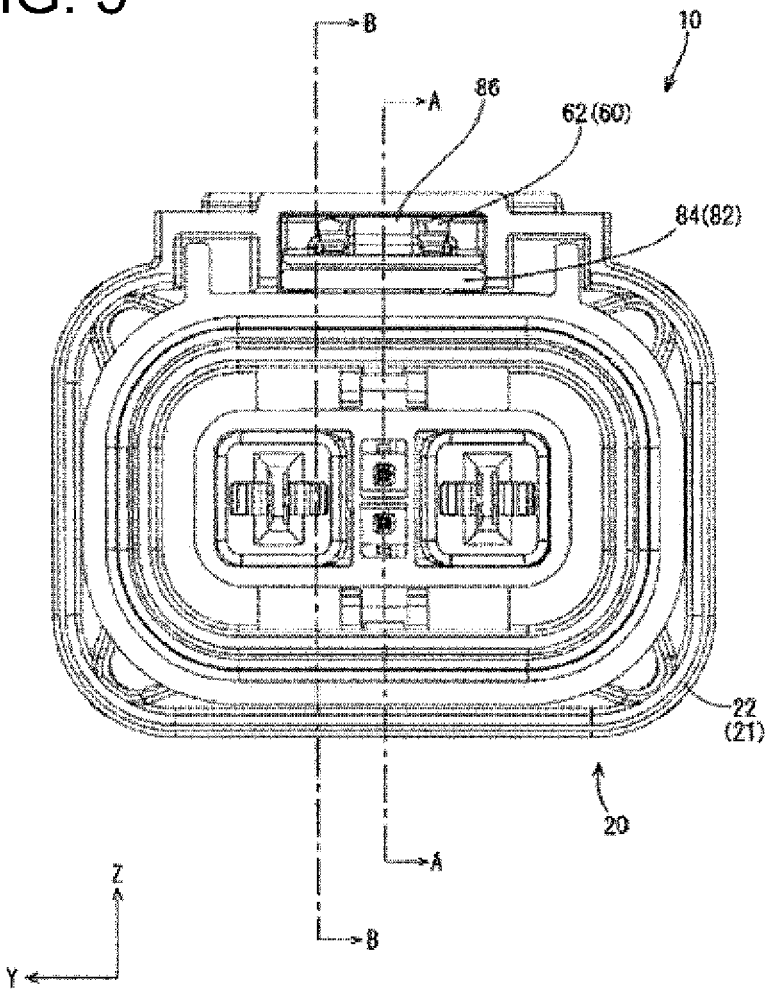
FIG. 5 is a front view of the connector.
Figure 14:
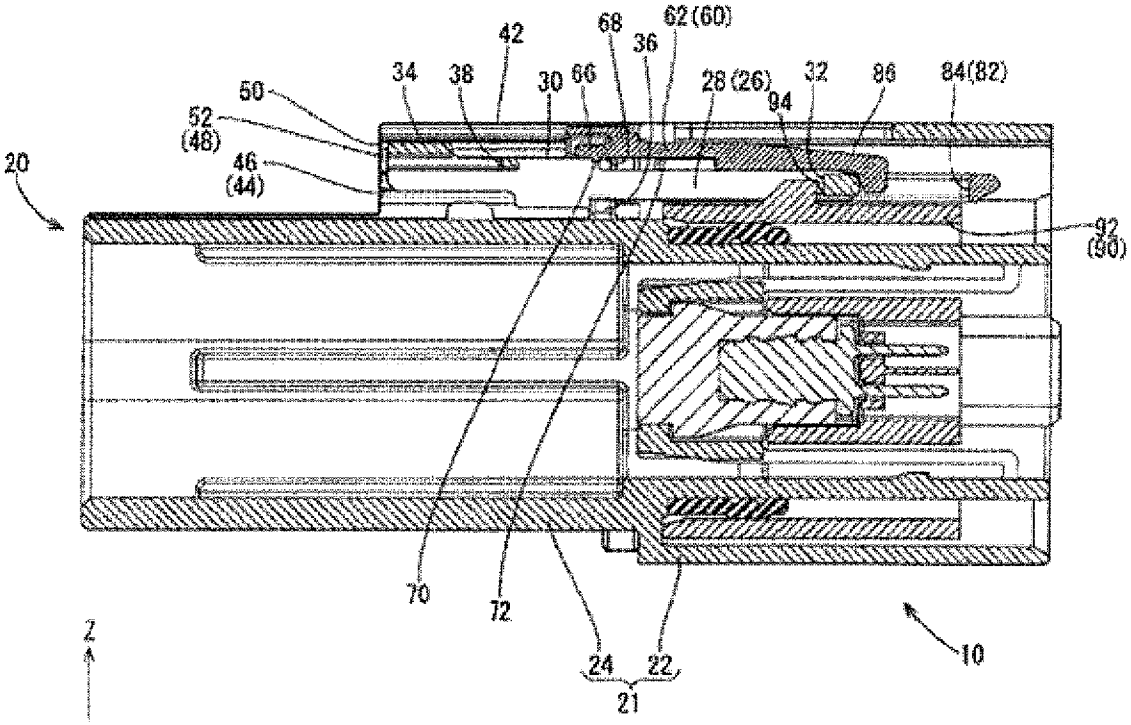
FIG. 14 is a section along A-A of FIG. 5 in a state where the connection detecting member is at a connection assurance position.

A connector 10 of this embodiment includes a female housing 20 and a connection detecting member 60 to be mounted slidably on the housing 20, as shown in FIG. 1. As shown in FIG. 14, the housing 20 is connected to a male mating housing 90. In the following description, a Z direction and a Y direction of FIG. 4 are referred to as an upward direction and a rightward direction, and a connecting direction of the housing 20 and the mating housing 90 is referred to as a forward direction.

Figure 6:
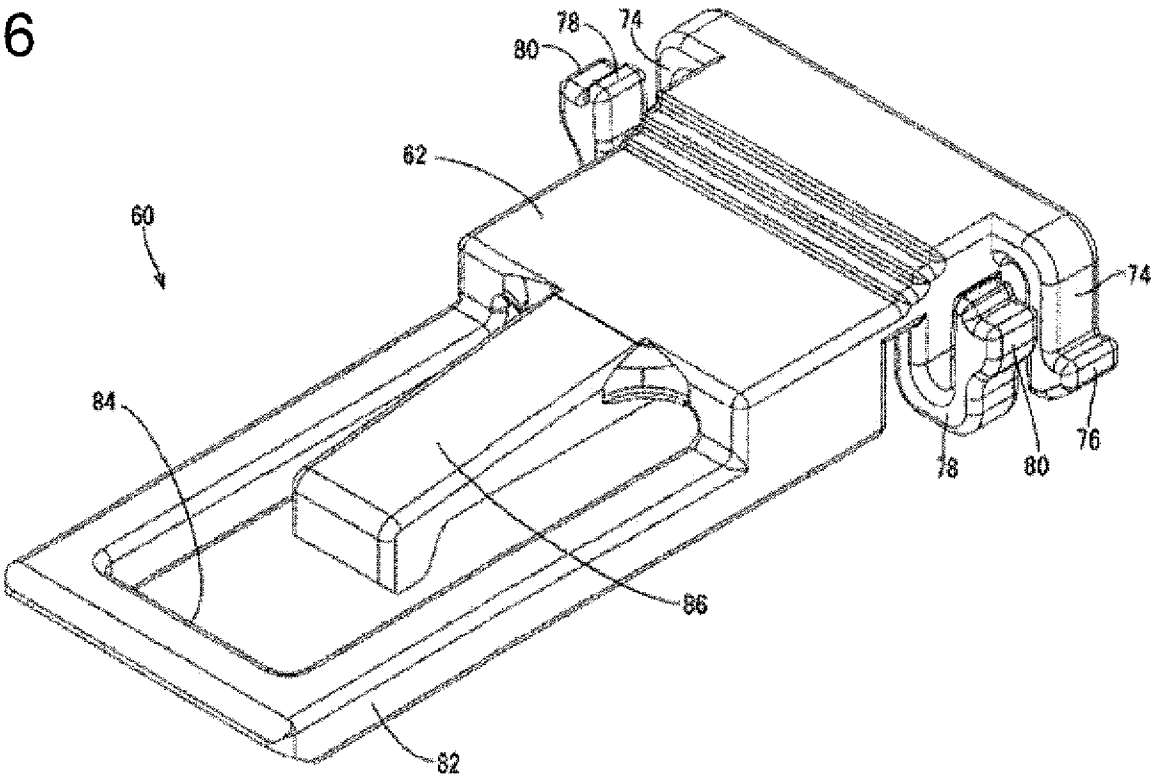
FIG. 6 is a front perspective view of a connection detecting member.

The connection detecting member 60 provides connection assurance by detecting that the housing 20 and the mating housing 90 are connected properly and is a functional member for realizing a so-called CPA (Connector Position Assurance). As shown in FIG. 6, the connection detecting member 60 includes a detecting member body 62 in the form of a rectangular plate, a frame-like latch 82 projecting forward from the front end of the detecting member body 62, and a connection detecting portion 86 cantilevered from the front end of the detecting member body 62. The front end surface in the frame of the latch 82 serves as a later-described latch lock 84 that contacts a mating lock 94 of the mating housing 90 while connection is being released.

Figure 7:
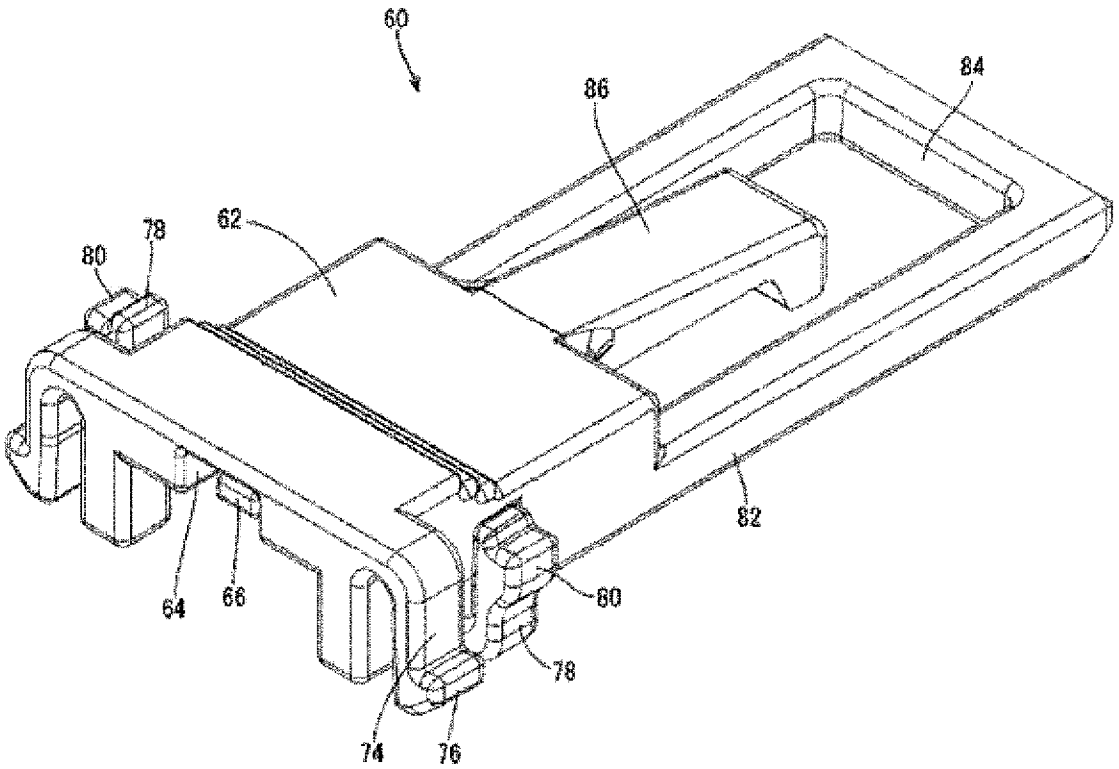
FIG. 7 is a rear perspective view of the connection detecting member.

As shown in FIGS. 6 and 7, two flexible first arms 74 and two flexible second arms 78 are provided on both left and right sides of the detecting member body 62 with the second arms 78 being forward of the first arms 74. The first arms 74 are cantilevered down from the both sides of the detecting member body 62, and first claws 76 project laterally out on tip parts of the first arms 74. The second arms 78 project down from the both sides of the detecting member body 62 and are folded to project up. Further, second claws 80 project laterally out on tip parts of the second arms 78.

Figure 8:
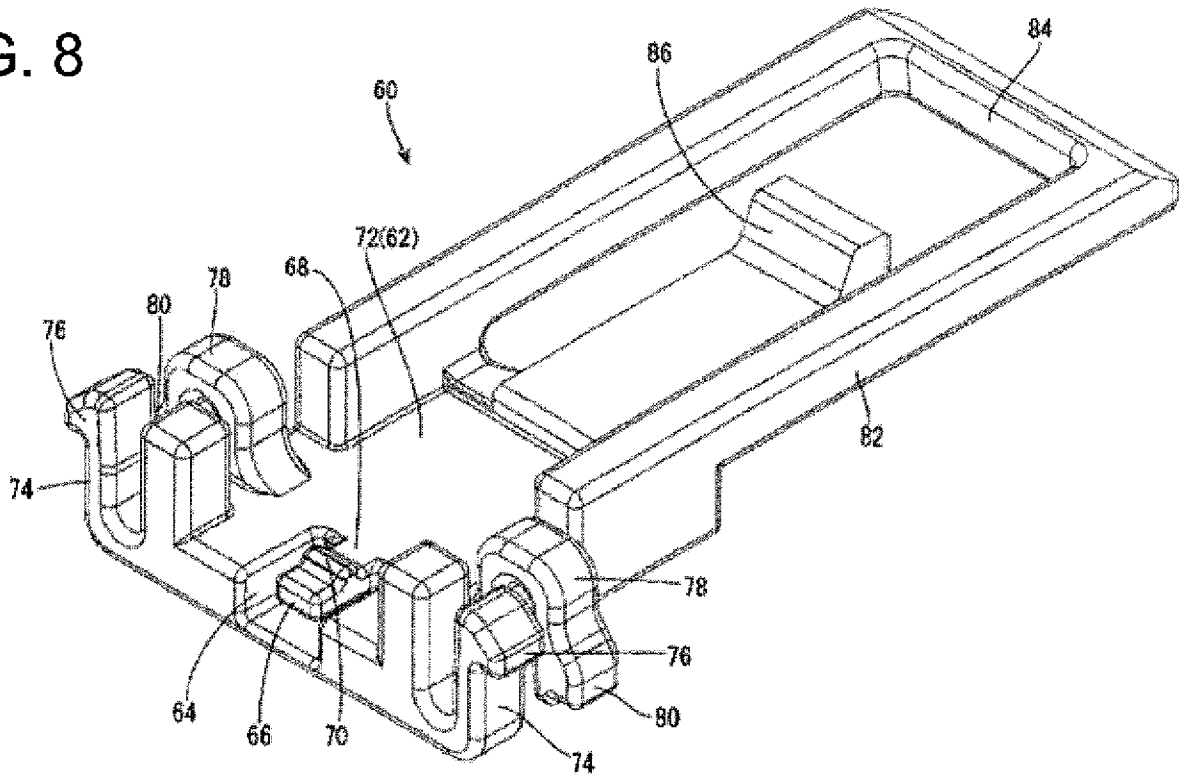
FIG. 8 is an underside perspective view of the connection detecting member.

As shown in FIG. 8, a locking lance accommodation groove 64 is open in a rear part of the lower surface of the detecting member body 62, and a locking lance 66 is cantilevered rearward from the front inner wall of the locking lance accommodation groove 64. The locking lance 66 is flexible and resiliently displaceable in a vertical direction. The lower surface of the locking lance 66 serves as a sliding surface 68 that slides against the housing 20 to be described later, and a projection (tip) 70 projects down from the sliding surface 68.

Figure 9:
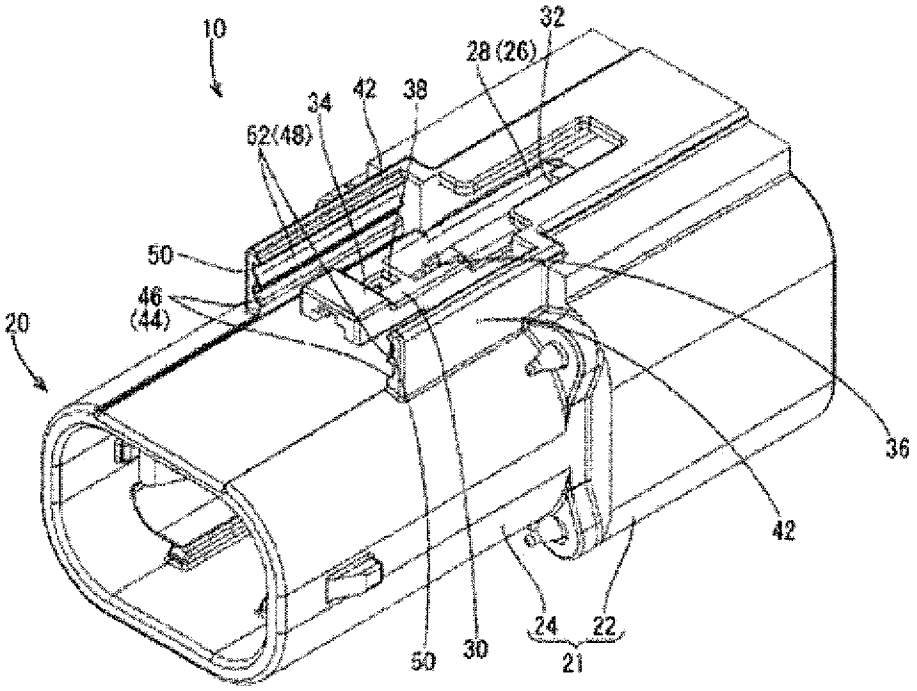
FIG. 9 is a rear perspective view of a housing.
Figure 10:
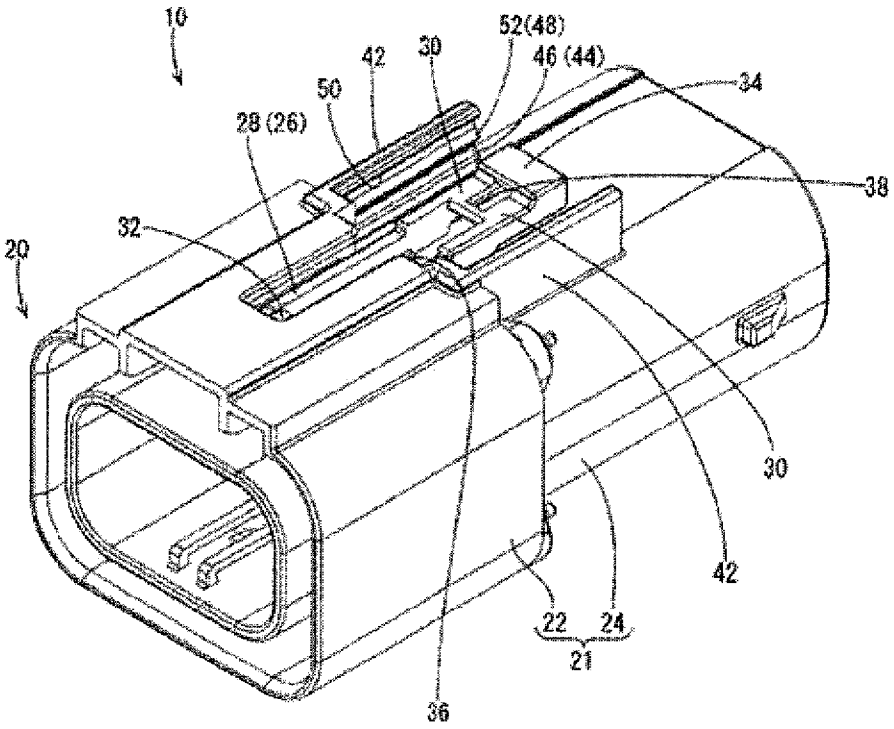
FIG. 10 is a front perspective view of the housing.

As shown in FIGS. 9 and 10, the housing 20 includes a receptacle 21 open forward and rearward. A lock arm 26 is provided on the upper surface of the receptacle 21 and left and right side walls 42 are provided on the upper surface of the receptacle 21.

Figure 2:
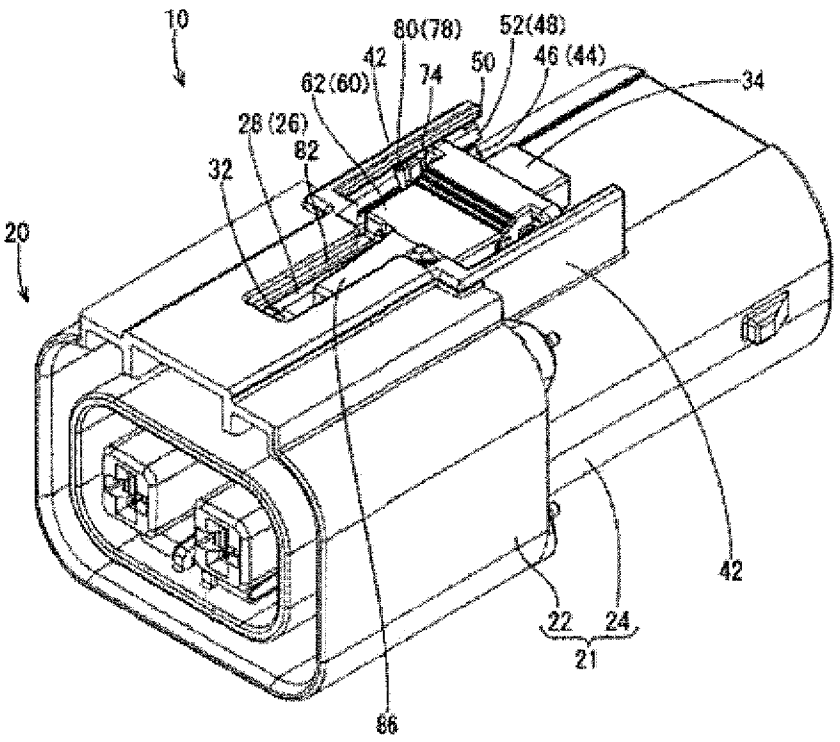
FIG. 2 is a front perspective view of the connector.
Figure 3:
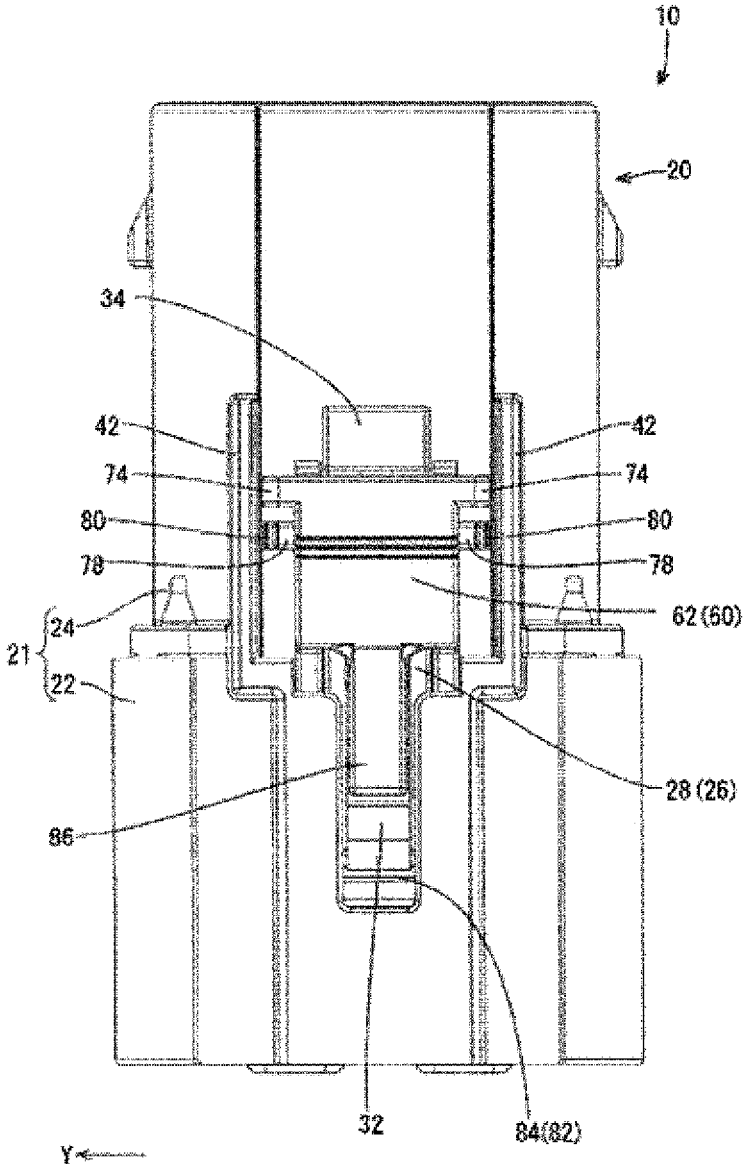
FIG. 3 is a plan view of the connector.

As shown in FIGS. 1 and 2, the receptacle 21 is composed of a front receptacle 22 open in a connecting direction and a rear receptacle 24 open in a direction opposite to the connecting direction.

As shown in FIG. 9, the lock arm 26 includes a lock arm body 28 having a rectangular shape long in a front-rear direction and having a frame-like opening. A base end 36 projects down from the lower surface of the lock arm body 28 and is connected to the upper surface of the rear receptacle 24. A rectangular pressing portion 34 is provided in a rear part of the upper surface of the lock arm body 28. If the pressing portion 34 is pressed down with a finger, the lock arm 26 is displaceable in a seesaw manner with the base end 36 as a fulcrum.

As shown in FIG. 9, a locking portion 38 is provided immediately in front of the pressing portion 34 of the lock arm body 28 and has a rectangular opening. The tip of the frame-like opening of the lock arm body 28 serves as a housing-side lock 32 that contacts the mating lock 94 of the mating housing 90 to be described later. The connection detecting member 60 is mounted slidably on the upper surface of the lock arm body 28.

As shown in FIG. 9, the side walls 42 project up from the upper surface of the rear receptacle 24 and are disposed laterally to the lock arm 26. Two first guide grooves 44 and two second guide grooves 48 are provided along a sliding direction (front-rear direction) of the connection detecting member 60 in surfaces of the side walls 42 facing each other. The second guide grooves 48 are disposed above the first guide grooves 44. The bottom surfaces of the first guide grooves 44 serve as first tapered surfaces 46 inclined toward the facing first guide grooves 44. Similarly, the bottom surfaces of the second guide grooves 48 serve as second tapered surfaces 52 inclined toward the facing second guide grooves 48.

Figure 11:
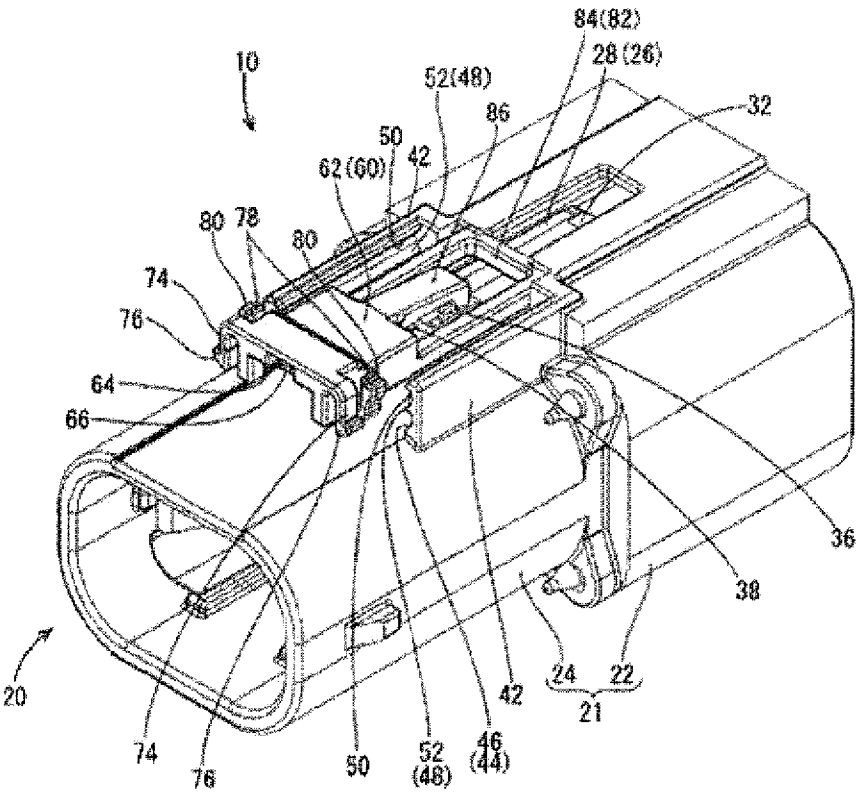
FIG. 11 is a perspective view before the connection detecting member is mounted on the housing.
Figure 12:
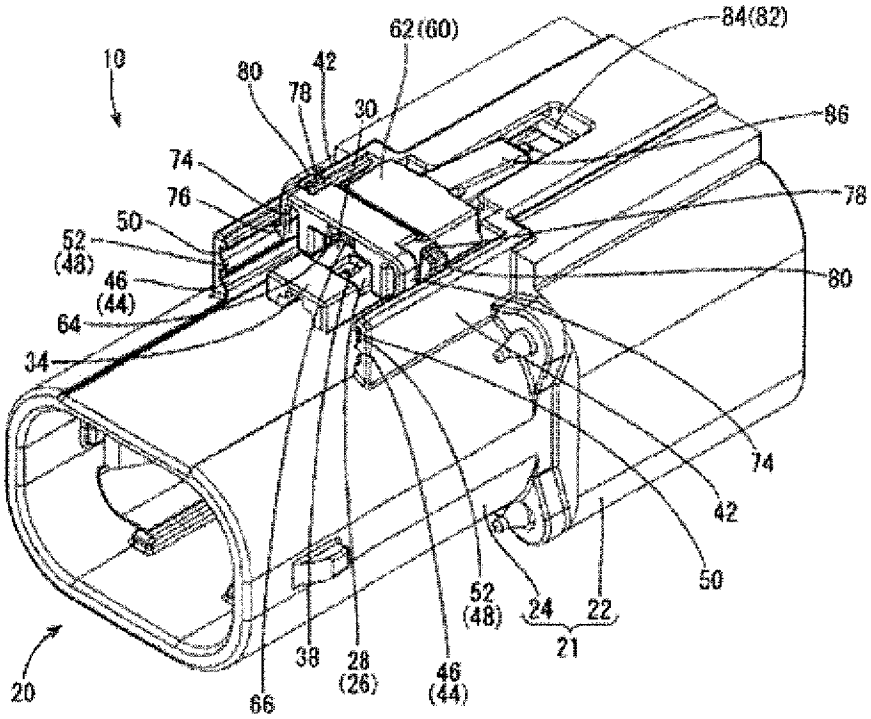
FIG. 12 is a perspective view in a state where the connection detecting member is at a pre-assembling position.
Figure 13:
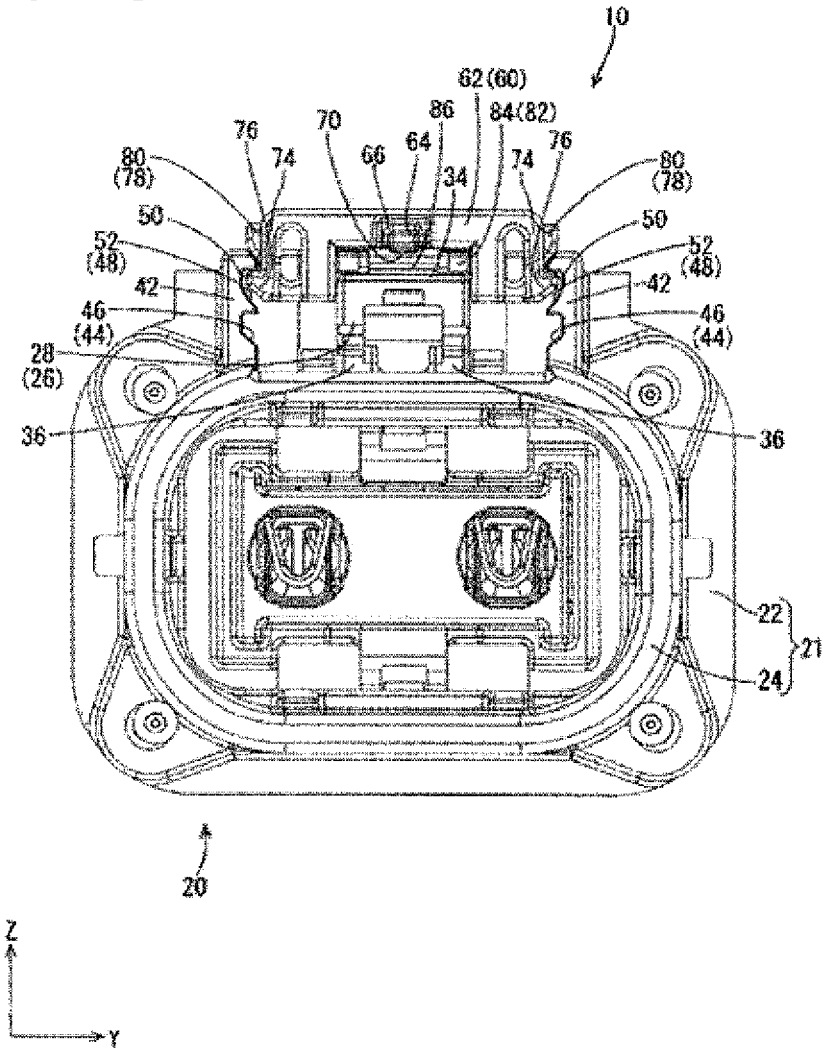
FIG. 13 is a back view in the state where the connection detecting member is at the pre-assembling position.

To mount the connection detecting member 60 on the housing 20, the first claws 76 of the first arms 74 of the connection detecting member 60 first are inserted into the second guide grooves 48 of the side walls 42, as shown in FIGS. 11 and 12 and the connection detecting member 60 is mounted at a pre-assembling position shown in FIGS. 12 and 13.

If the detecting member body 62 subsequently is pressed down, the first arms 74 slide against the second tapered surfaces 52 of the second guide grooves 48 to be deflected toward the facing first arms 74. Further, the second arms 78 slide against upper end parts of the side walls 42 to be deflected toward the facing second arms 78. In this way, the first arms 74 come out of the second guide grooves 48 and the lower surface of the pressed detecting member body 62 comes into contact with the upper surface of the lock arm body 28 to stop a downward displacement of the connection detecting member 60, and the connection detecting member 60 is positioned. At this time, as shown in FIG. 4, the deflected first arms 74 are restored and the first claws 76 enter the first guide grooves 44. Further, the two deflected second arms 78 are restored and the second claws 80 enter the second guide grooves 48. Further, since the projection 70 of the locking lance 66 is located in the locking portion 38 and the projection 70 comes into contact with the inner wall of the locking portion 38 if the connection detecting member 60 is displaced in the connecting direction, the connection detecting member 60 is locked by the locking portion 38. This position is a later-described connection assurance release position of the connection detecting member 60 shown in FIGS. 1 and 15. In the above way, the connection detecting member 60 can be mounted on the housing 20.

Figure 16:
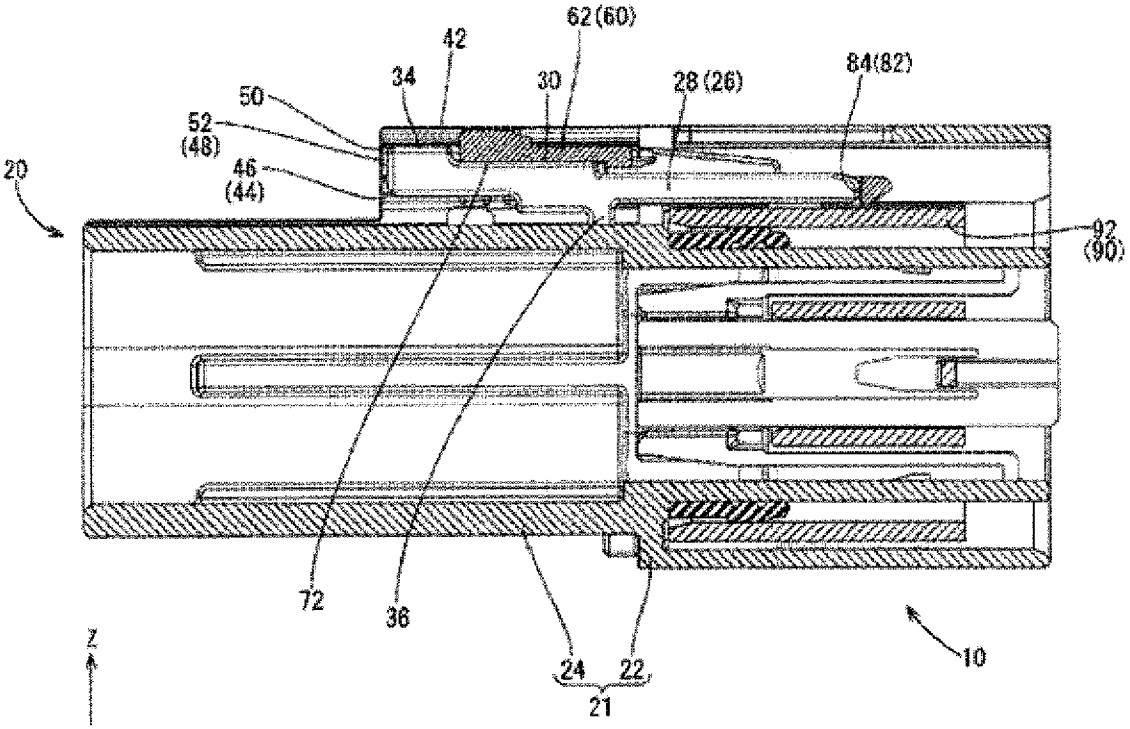
FIG. 16 is a section along B-B of FIG. 5 in the state where the connection detecting member is at the connection assurance release position.
Figure 17:
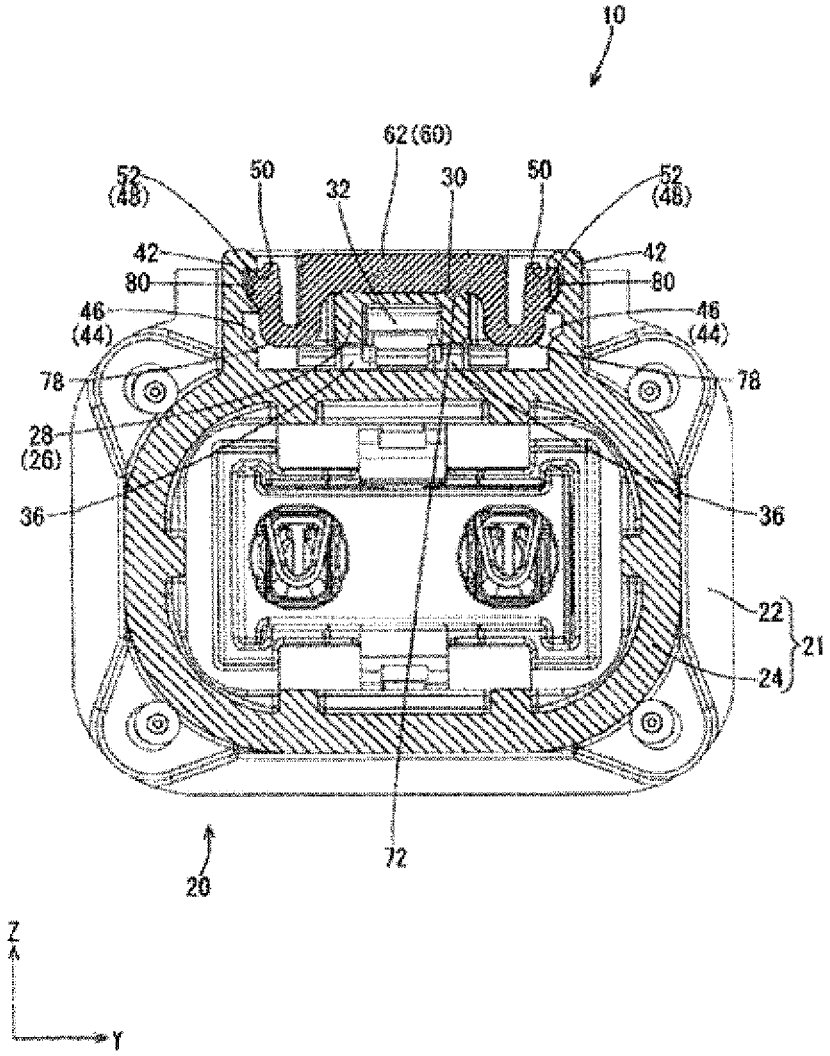
FIG. 17 is a back view in section at the position of second arm portions in the state where the connection detecting member is at the connection assurance release position.

At the connection assurance release position, a housing-side contact surface 30, which is the upper surface of the lock arm body 28 of the housing 20, and a detecting member-side contact surface 72, which is the lower surface of the detecting member body 62 of the connection detecting member 60, are in contact as shown in FIG. 16. Further, as shown in FIG. 17, the upper surfaces of the second claws 80 of the second arms 78 contact arm contact portions 50, which are the ceiling surfaces of the second guide grooves 48 of the housing 20. By this arrangement, a vertical displacement of the connection detecting member 60 is restricted and the rattling of the connection detecting member 60 is suppressed since the second arms 78 are in contact with the arm contacts 50 of the housing 20 in a direction (upward direction) opposite to a direction from the detecting member-side contact surface 72 to the housing-side contact surface 30 (downward direction).

Further, the second claws 80 of the second arms 78 are resiliently in contact with the arm contact portions 50 of the second guide grooves 48, and the detecting member-side contact surface 72 presses the housing-side contact surface 30 by reaction forces from the second claws 80 of the second guide grooves 48. In this way, the housing-side contact surface 30 and the detecting member-side contact surface 72 are held reliably in contact As shown in FIG. 15, the mating housing 90 includes a mating receptacle 92 open in the connecting direction and the mating lock 94 projecting up from the upper surface of the mating receptacle 92.

Figure 15:
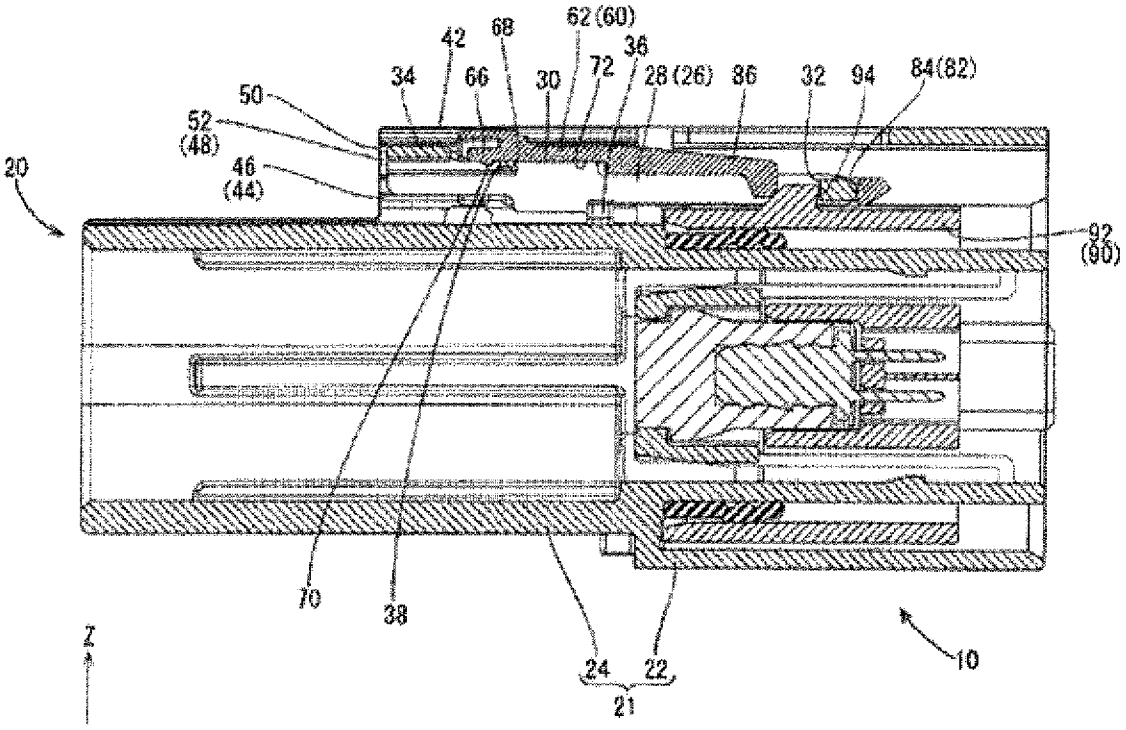
FIG. 15 is a section along A-A of FIG. 5 in a state where the connection detecting member is at a connection assurance release position.

If the housing 20 and the mating housing 90 are connected, the mating lock 94 is located forward of the housing-side lock 32 and the latch lock 84 in the connecting direction when viewed from the side of the housing 20, as shown in FIG. 15. In separating the mating housing 90 from the housing 20, the locking of the mating lock 94 and the housing-side lock 32 is released in a first action and, subsequently, the locking of the mating lock 94 and the latch lock 84 is released in a second action. In this way, the mating housing 90 is separated in two actions.

If the connection detecting member 60 is slid in the connecting direction with the housing 20 and the mating housing 90 connected and the connection detecting member 60 located at the connection assurance release position shown in FIG. 15, the projection 70 of the locking lance 66 is displaced resiliently up while coming into contact with and sliding against the inner wall of the locking portion 38. Thus, the projection 70 rides on the locking portion 38. Since the locking lance 66 is displaced resiliently if the projection 70 rides over the locking portion 38 in this way, a stress applied to the projection 70 when the projection 70 comes into contact with the inner wall of the locking portion 38 is reduced and the projection 70 can be prevented from being scraped by repeatedly riding on the locking portion 38.

If the connection detecting member 60 is slid farther in the connecting direction, a tip part of the connection detecting portion 86 rides over the mating lock 94 and the housing-side lock 32, as shown in FIG. 14. This position of the connection detecting member 60 is a connection assurance position. Further, when the connection detecting member 60 is slid, the second claws 80 of the second arms 78 slide against the arm contacts 50 of the second guide grooves 48 and the second arms 78 are deflected in directions facing each other. In this way, the connection detecting member 60 can be slid smoothly.

With the housing 20 and the mating housing 90 properly connected, the connection detecting member 60 can be displaced from the connection assurance release position, shown in FIG. 15, to the connection assurance position, shown in FIG. 14. On the other hand, in a state where the housings are not properly connected, the connection detecting member 60 cannot be displaced to the connection assurance position. For example, if the mating lock 94 is located below the housing-side lock 32, the connection detecting portion 86 contacts the housing-side lock 32 even if the connection detecting member 60 is slid in the connecting direction. Thus, the connection detecting member 60 cannot be displaced to the connection assurance position.

The procedure of releasing the connection of the housing 20 and the mating housing 90 with the connection detecting member 60 located at the connection assurance position is described.

Figure 18:
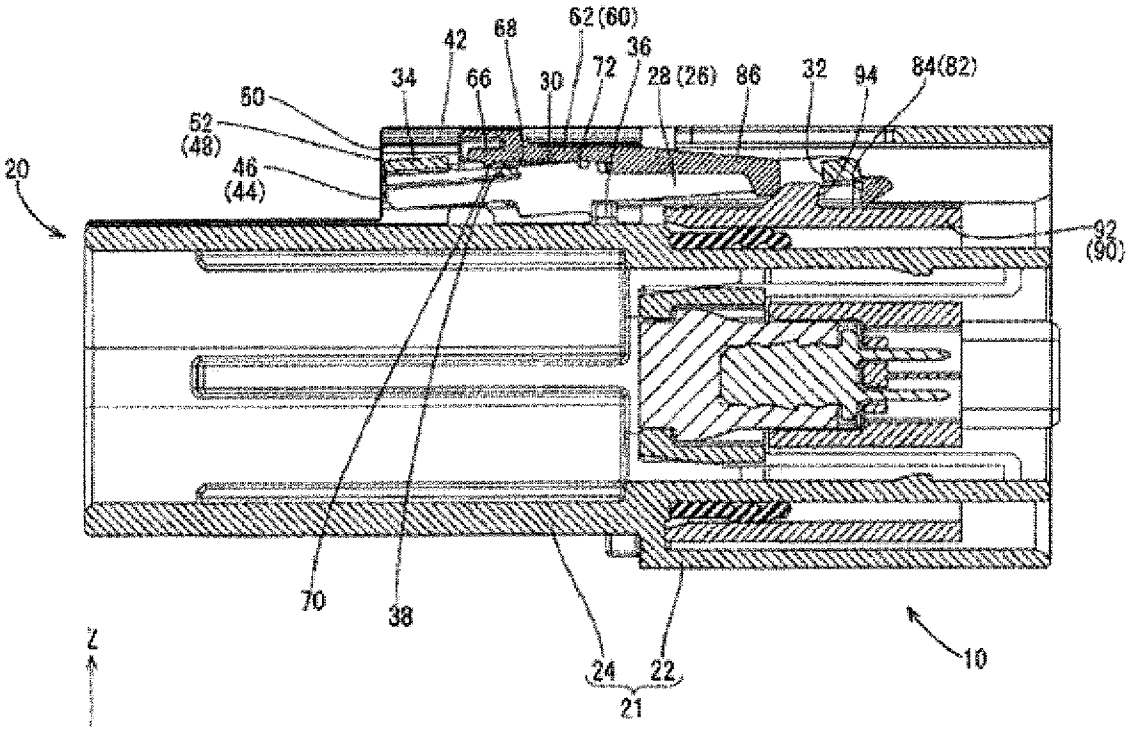
FIG. 18 is a section along A-A of FIG. 5 during a separating operation in a first action.
Figure 19:
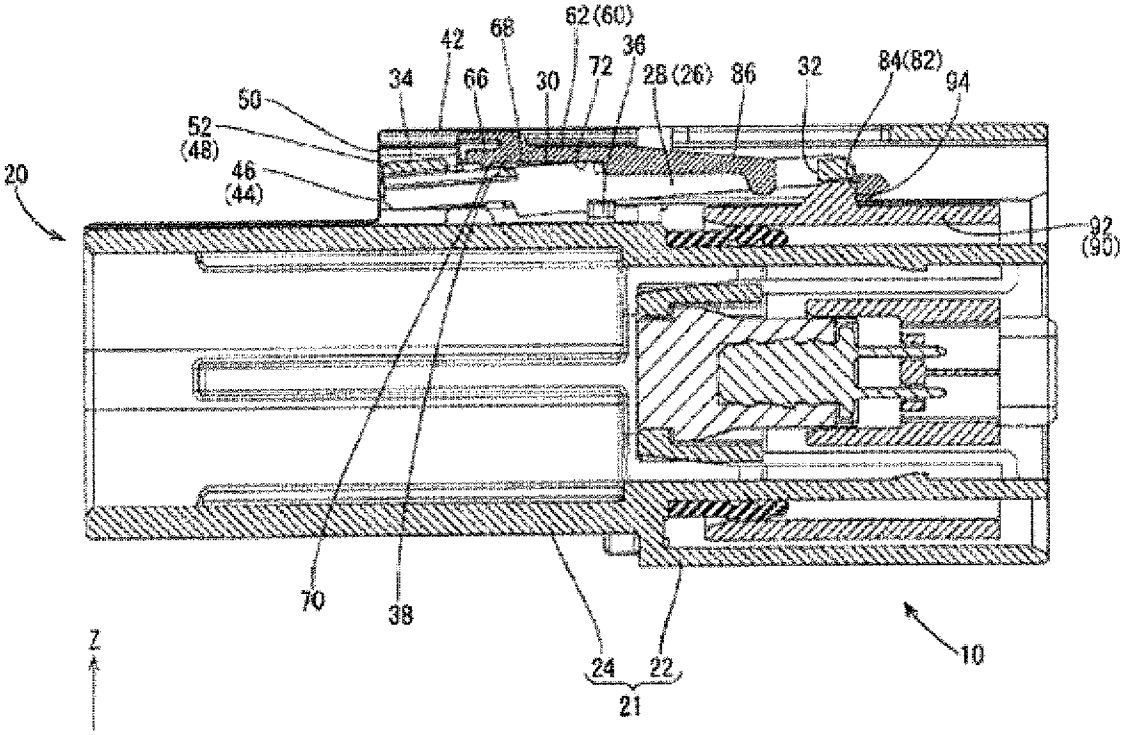
FIG. 19 is a section along A-A of FIG. 5 during the separating operation in the first action.
Figure 20:
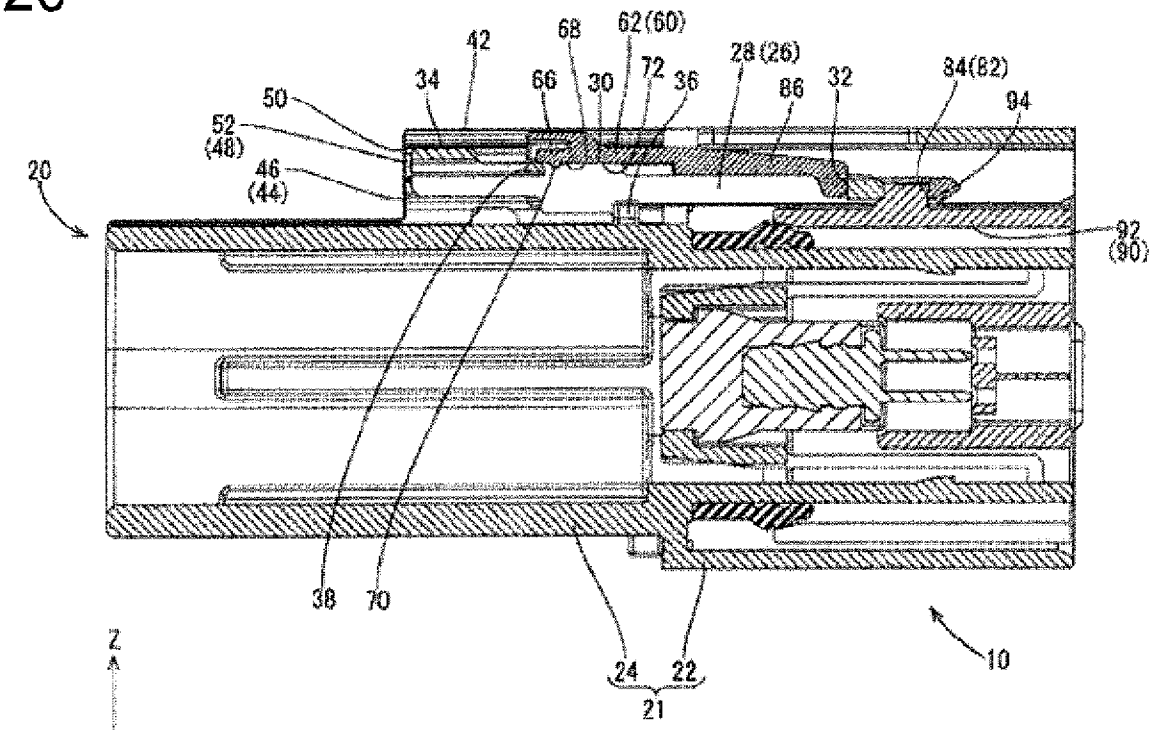
FIG. 20 is a section along A-A of FIG. 5 after the completion of the separating operation in the first action.

First, the connection detecting member 60 at the connection assurance position shown in FIG. 14 is pulled in the direction opposite to the connecting direction and set at the connection assurance release position shown in FIG. 15. If the pressing portion 34 of the lock arm 26 subsequently is pressed down, the housing-side lock 32 is displaced up, as shown in FIG. 18. If the mating housing 90 subsequently is pulled in the direction opposite to the connecting direction, the mating lock 94 contacts the latch lock 84, as shown in FIG. 19. If the mating housing 90 subsequently is pulled farther in the direction opposite to the connecting direction, the mating lock portion 94 pulls the latch lock 84 and the connection detecting member 60 also is displaced in the same direction as the mating housing 90. In this way, the mating lock 94 is located between the housing-side lock 32 and the latch lock 84, as shown in FIG. 20, and the separation of the mating housing 90 in the first action is completed.

Figure 21:
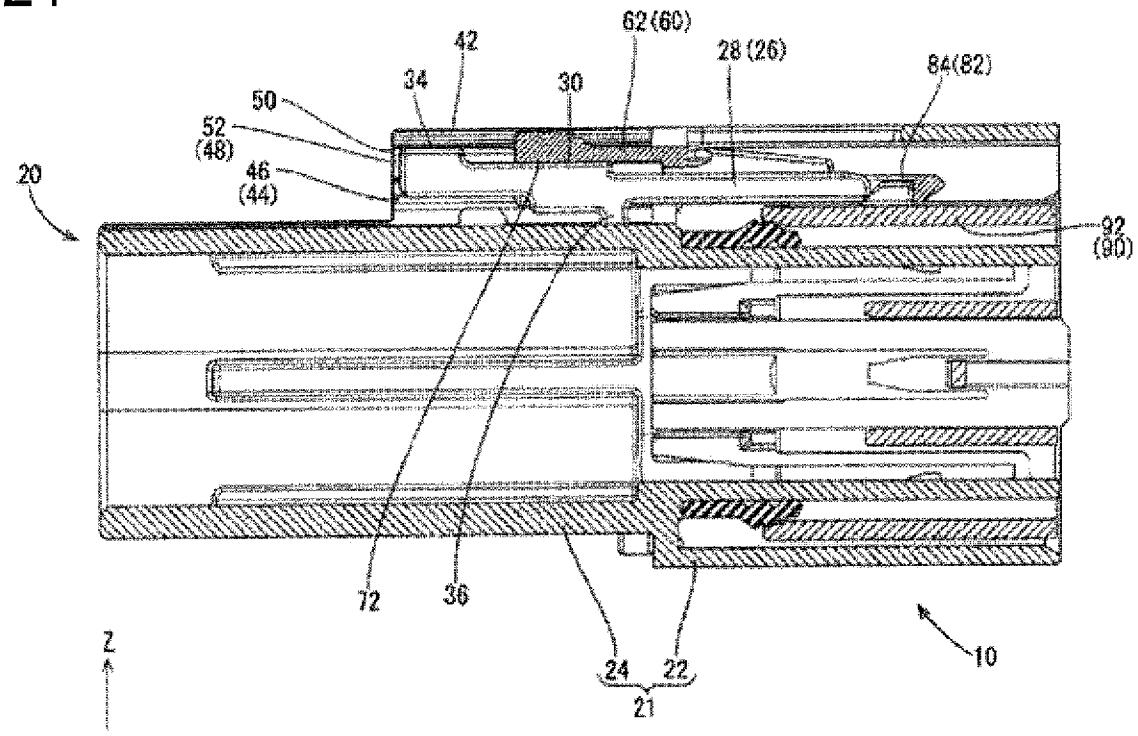
FIG. 21 is a section along B-B of FIG. 5 after the completion of the separating operation in the first action.
Figure 22:
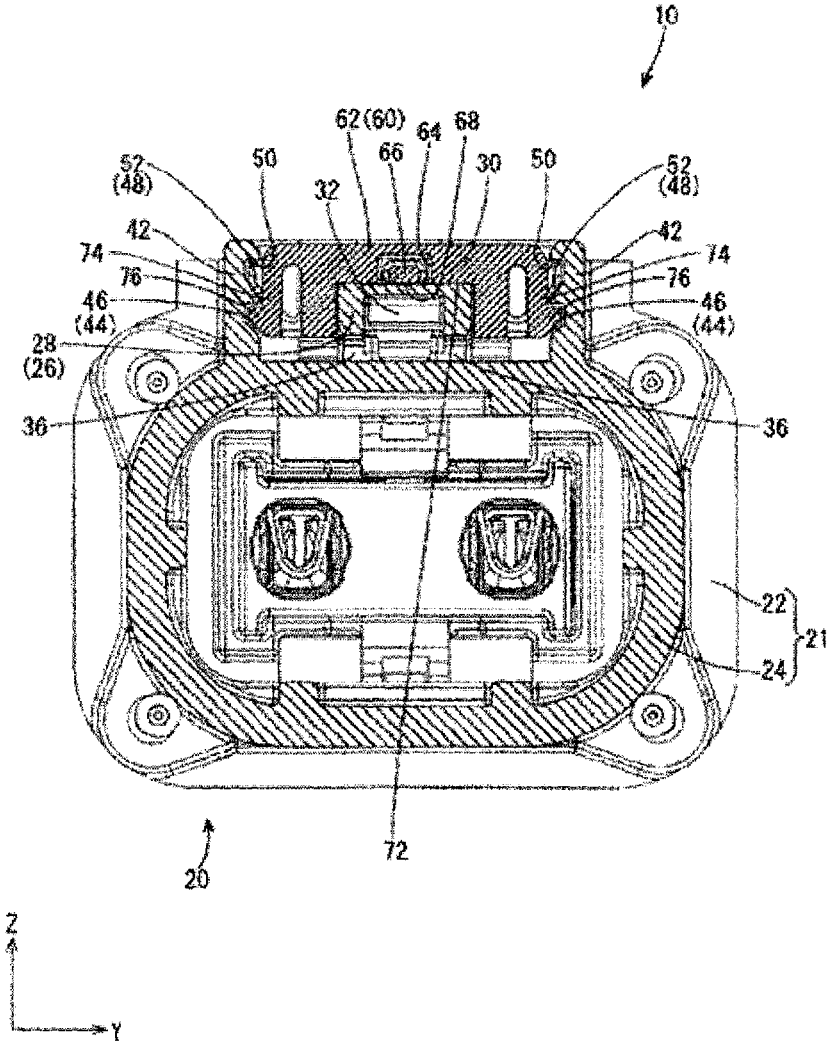
FIG. 22 is a back view in section at the position of the second arm portions after the completion of the separating operation in the first action.

Also, when the separation in the first action is completed, the housing-side contact surface 30 and the detecting member-side contact surface 72 are in contact, as shown in FIG. 21, as at the connection assurance release position. Further, as shown in FIG. 22, the upper surfaces of the second claws 80 of the connection detecting member 60 and the arm contacts 50, which are the ceiling surfaces of the second guide grooves 48 of the housing 20, are in contact. In this way, vertical rattling of the connection detecting member 60 is suppressed when the separation in the first action is completed. Thus, the latch lock 84 cannot be displaced upwardly and the mating housing 90 is separated without the separating operation by the rattling of the connection detecting member 60.

Figure 23:
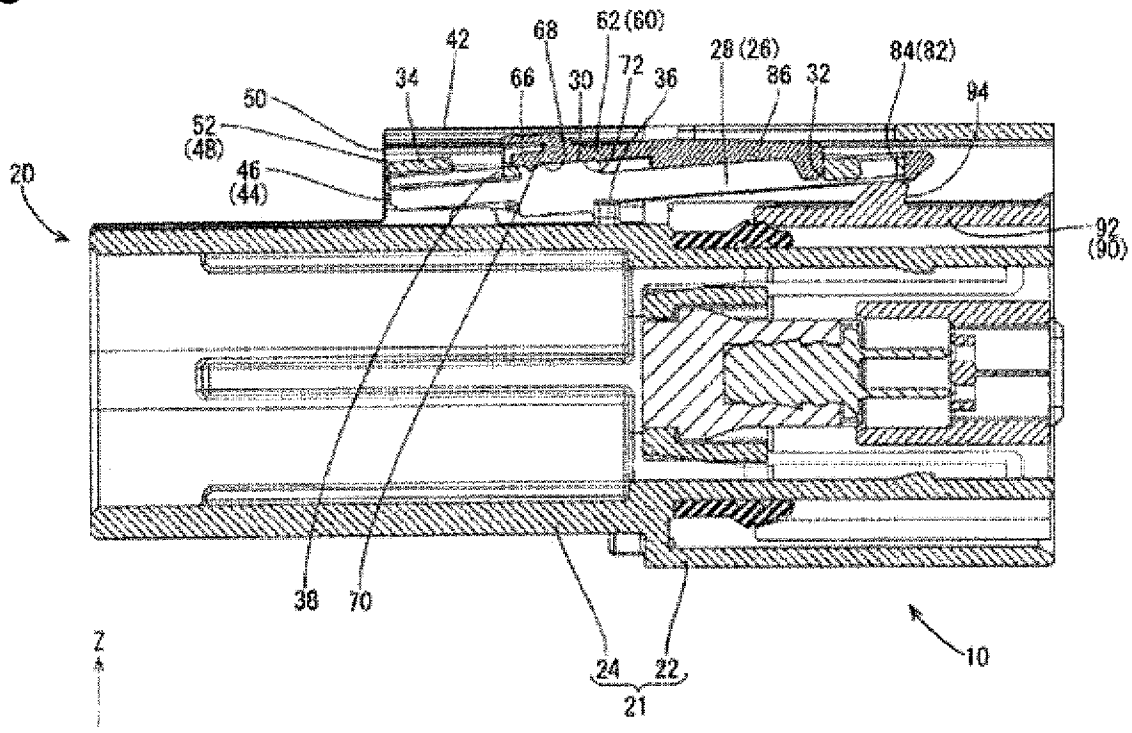
FIG. 23 is a section along A-A of FIG. 5 during a separating operation in a second action.
Figure 24:
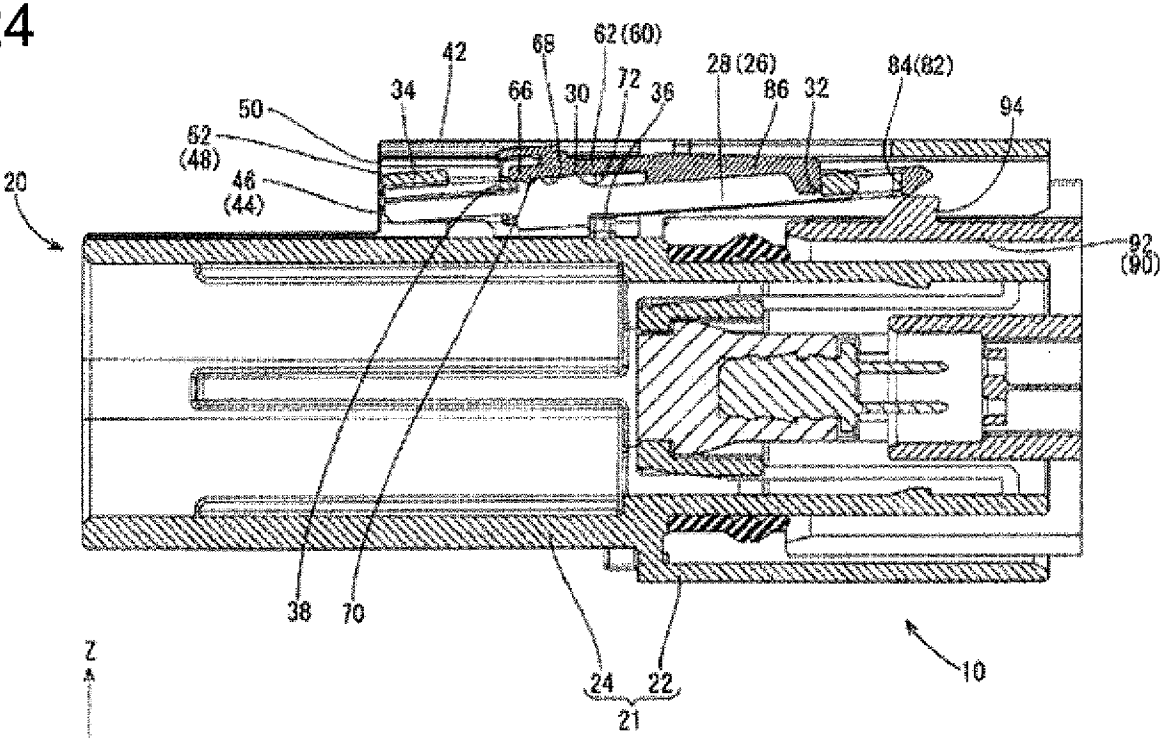
FIG. 24 is a section along A-A of FIG. 5 during the separating operation in the second action.
Figure 25:
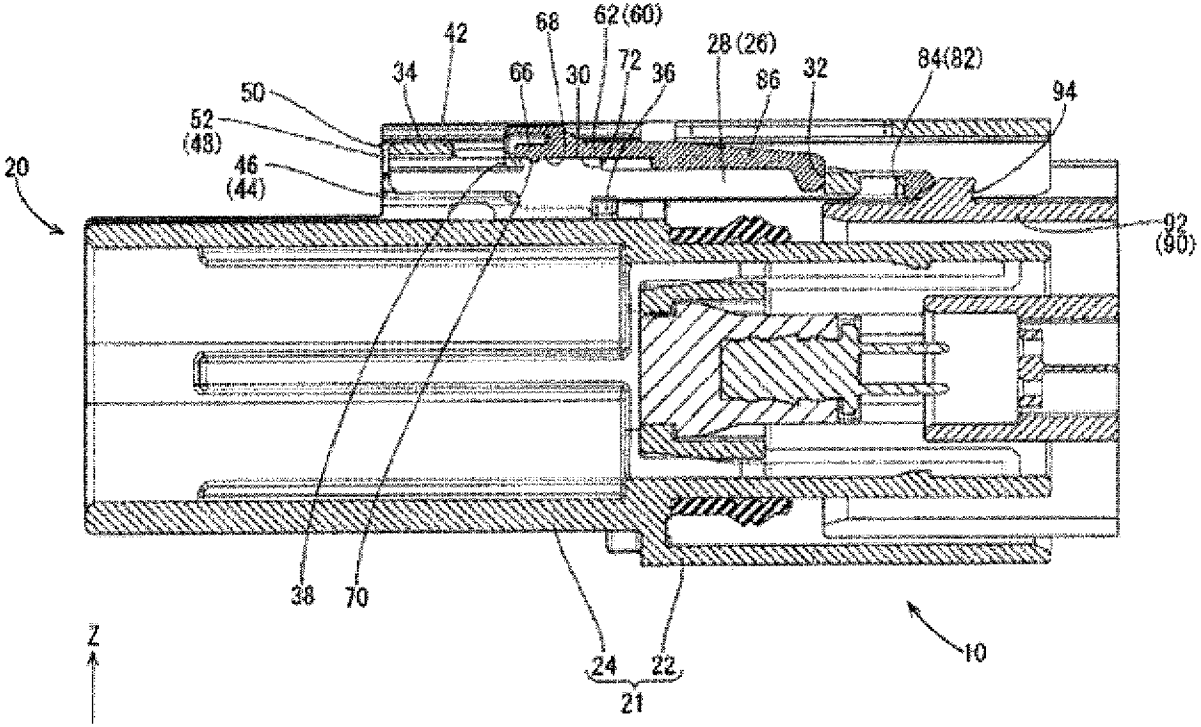
FIG. 25 is a section along A-A of FIG. 5 after the completion of the separating operation in the second action.

Subsequently, if the pressing portion 34 of the lock arm 26 is pressed, the latch lock 84 of the connection detecting member 60 also is displaced up together with the housing-side lock 32, as shown in FIG. 23. Subsequently, if the mating housing 90 is pulled in the direction opposite to the connecting direction, as shown in FIGS. 24 and 25, the separation of the mating housing 90 in the second action is completed.

As described above, according to this embodiment, the locking lance 66 is displaced resiliently if the projection (tip) 70 of the locking lance 66 comes into contact with the inner wall of the locking portion 38. Thus, a stress applied to the projection (tip) 70 of the locking lance 66 can be alleviated, and the projection (tip) 70 of the locking lance 66 can be prevented from being scraped as compared to the case where the locking lance 66 is not resiliently displaced.

Further, since the locking lance 66 is parallel to the sliding direction of the connection detecting member 60, the locking lance 66 is displaced resiliently in a direction opposite to a projecting direction of the projection (tip) 70 if the projection (tip) 70 of the locking lance 66 contacts the inner wall of the locking portion 38 by sliding the connection detecting member 60. In this way, the locking of the connection detecting member 60 with the housing 20 can be released.

Second Embodiment

Figure 26:
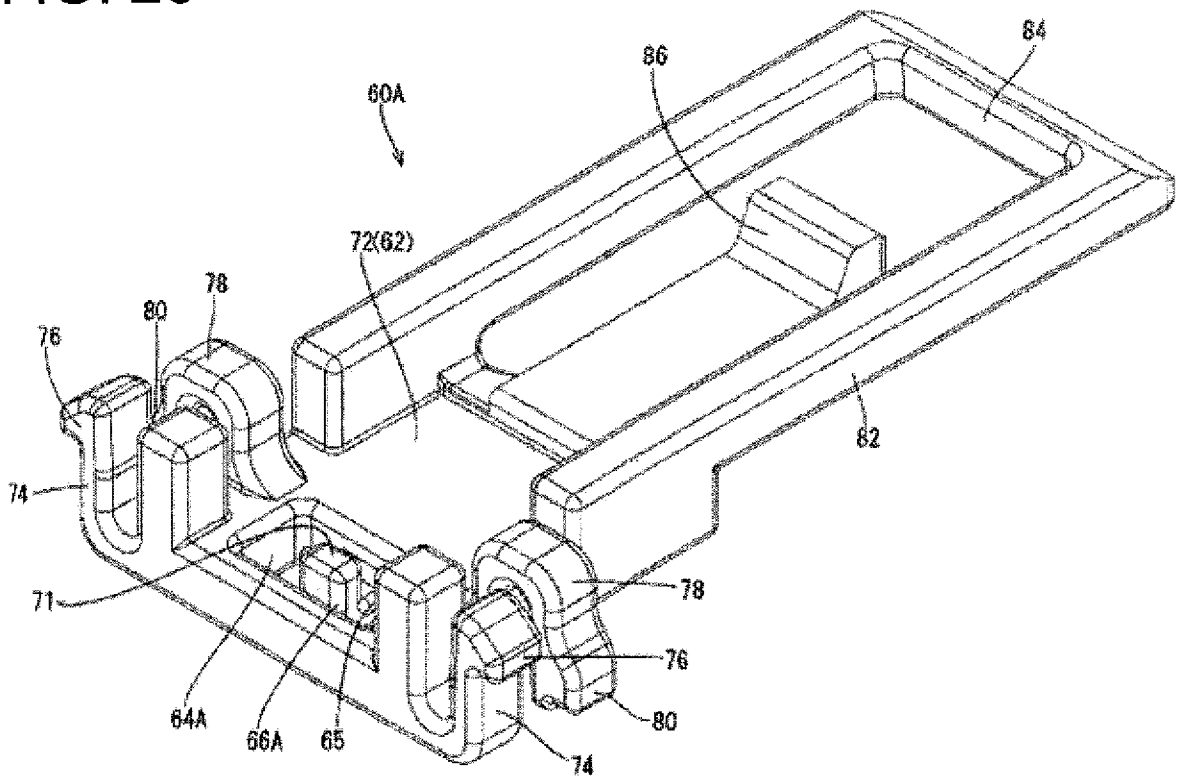
FIG. 26 is an underside perspective view of a connection detecting member in a second embodiment.

A second embodiment is described with reference to FIGS. 26 to 28.

A connector 10A of this embodiment differs from the first embodiment in the shape of the connection detecting member 60. As shown in FIG. 26, a locking lance accommodation groove 64A is open in a rear part of the lower surface of a connection detecting member body 62A of a connection detecting member 60A, and a locking lance supporting portion 65 linking front and rear inner walls is provided in the locking lance accommodation groove 64A, as shown in FIGS. 26 and 27. Further, a flexible and cantilevered locking lance 66A projects down from the lower surface of the locking lance supporting portion 65. A tip part 71 of the locking lance 66A is exposed from an opening of the locking lance accommodation groove 64A, as shown in FIG. 27. The other shape is the same as in the first embodiment and not described.

Figure 27:
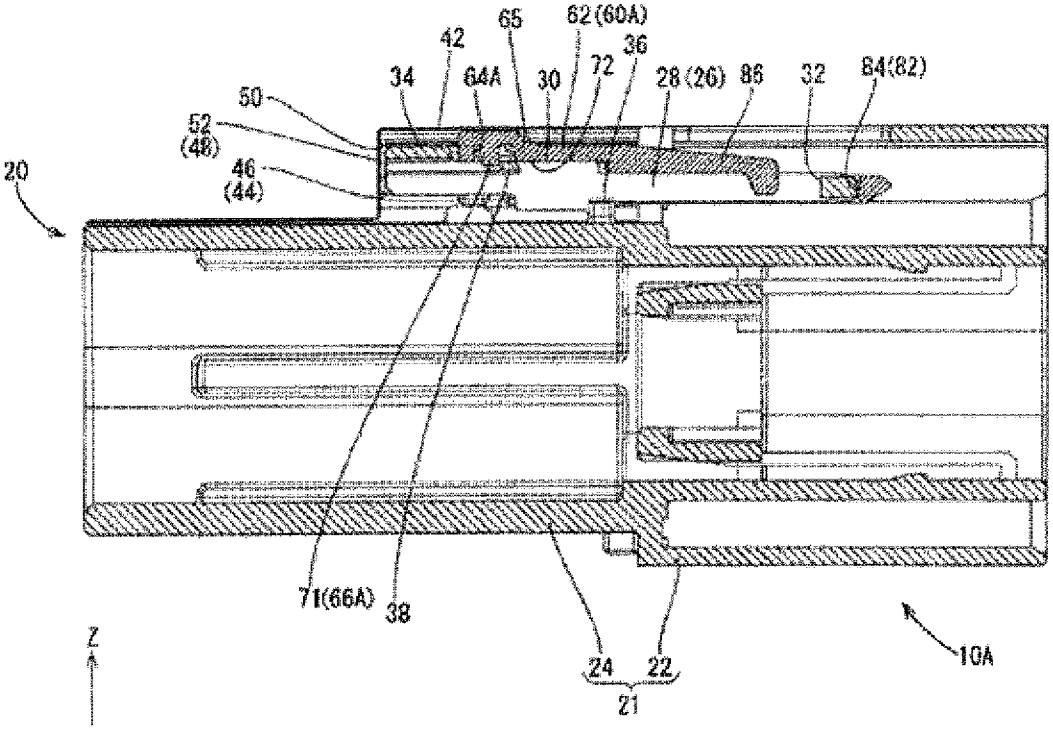
FIG. 27 is a side view in section at a connection assurance release position in the second embodiment.
Figure 28:
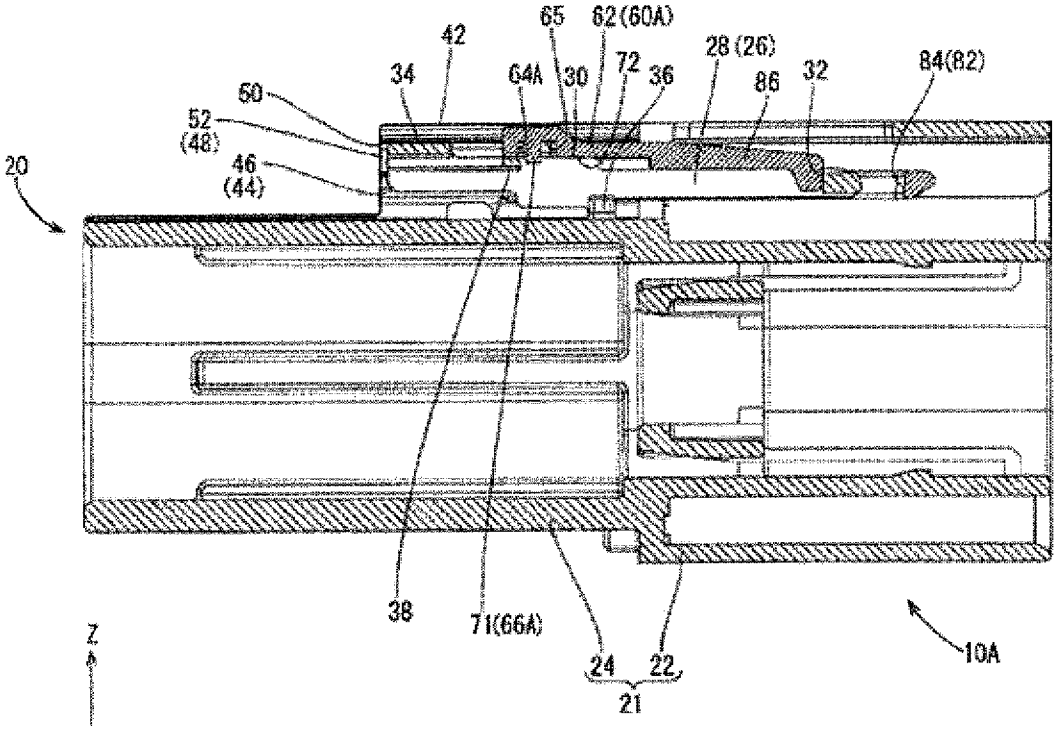
FIG. 28 is a side view in section at a connection assurance position in the second embodiment.

If the connection detecting member 60A is mounted on a housing 20, the tip part 71 of the locking lance 66A is accommodated inside a locking portion 38 at a connection assurance release position, as shown in FIG. 27. If the connection detecting member 60A is slid in a connecting direction and displaced from a connection assurance release position shown in FIG. 27 to the connection assurance position shown in FIG. 28, the tip 71 of the locking lance 66A contacts the inner wall of the locking portion 38 and slides against this inner wall, and the locking lance 66A is displaced resiliently in a direction (rearward) opposite to a sliding direction. In this way, the locking of the locking lance 66A is released. The locking lance 66A is displaced resiliently in this way. Thus, a stress acting on the tip 71 of the locking lance 66A is reduced and the tip 71 of the locking lance 66A is prevented from being scraped even if the tip 71 of the locking lance 66A repeatedly comes into contact with the inner wall of the locking portion 38.

As described above, according to this embodiment, the locking lance 66A projects into the locking portion 38 at the connection assurance release position. Thus, the locking lance 66 is displaced resiliently in the direction opposite to the sliding direction if the tip 71 of the locking lance 66A comes into contact with the inner wall of the locking portion 38 when the connection detecting member 60A is slid. In this way, the locking of the connection detecting member 60A with the housing 20 can be released.

Other Embodiments

The invention is not limited to the above described and illustrated embodiments. For example, the following various modes are also included.

Although the locking lance 66, 66A is cantilevered rearward from the front inner wall of the locking lance accommodation groove 64, 64A in the above embodiments, a locking lance may be cantilevered forward from the rear surface of a locking lance accommodation groove.

Although the connection detecting member 60, 60A includes the latch 82 and the connection detecting portion 86 in the above embodiments, a connection detecting member may include no latch.

Although the second claw portions 80 of the second arms 78 are configured to resiliently contact the arm contacts 50 of the second guide grooves 48 in the above embodiments, the second claws 80 of the second arms 78 may not be in contact with the arm contacts 50 of the second guide grooves 48.

LIST OF REFERENCE SIGNS

10, 10A . . . connector
20 . . . housing
38 . . . locking portion
60, 60A . . . connection detecting member
66, 66A . . . locking lance
68 . . . sliding surface
70 . . . projection (tip)
71 . . . tip
90 . . . mating housing

The invention claimed is:

1. A connector, comprising:

a housing to be connected to a mating housing; and a separate connection detecting member to be slidably mounted on the housing for connection assurance of the housing and the mating housing, wherein:

the connection detecting member is provided with a flexible and cantilevered locking lance, the housing is provided with a locking portion having an opening, the locking lance projecting into the opening of the locking portion, the locking portion being capable of locking the connection detecting member by a tip part of the locking lance coming into contact with an inner wall of the locking portion, the connection detecting member is slidably relatively displaceable between a connection assurance position where the connection assurance is made and the connection detecting member is locked by the locking portion, and a connection assurance release position where the connection assurance is released and locking of the connection detecting member with the locking portion is released, the tip part of the locking lance slides against the inner wall of the locking portion by sliding the connection detecting member during a displacement from the connection assurance release position to the connection assurance position, whereby the locking lance is resiliently displaced in a direction opposite to a sliding direction of the connection detecting member from the connection assurance release position to the connection assurance position and the locking of the connection detecting member is released, and the locking lance is resiliently displaced when the connection detecting member is displaced from the connection assurance release position to the connection assurance position, whereby the locking of the connection detecting member is released.

2. The connector of claim 1, wherein:

the connection detecting member is mounted slidably on the housing and displaceable from the connection assurance release position to the connection assurance position by being slid, the locking lance is parallel to a sliding direction of the connection detecting member, the tip part of the locking lance projects into the locking portion from a sliding surface of the locking lance against the housing at the connection assurance release position, and the tip part of the locking lance comes into contact with the inner wall of the locking portion by sliding the connection detecting member during a displacement from the connection assurance release position to the connection assurance position, whereby the locking lance is resiliently displaced in a direction opposite to a projecting direction of the tip part and the locking of the connection detecting member is released.

* * * * *